US005476077A

United States Patent [19]

Nishio

[11] Patent Number: 5,476,077

[45] Date of Patent: Dec. 19, 1995

[54] THERMOSTAT-MOUNTING POSITION STRUCTURE

[75] Inventor: Yasuaki Nishio, Shizuoka, Japan

[73] Assignee: Suzuki Motor Corporation, Shizuoka, Japan

[21] Appl. No.: 377,479

[22] Filed: Jan. 24, 1995

[30] Foreign Application Priority Data

Jun. 30, 1994 [JP] Japan ..... 6-171735

[51] Int. Cl.[6] ..... F02F 7/00

[52] U.S. Cl. ..... 123/195 R; 123/58.1

[58] Field of Search ..... 123/41.1, 58.1, 123/195 R, 195 A

[56] References Cited

FOREIGN PATENT DOCUMENTS 62-199921 9/1987 Japan .

4-276137 10/1992 Japan .

5-17383 5/1993 Japan .

*Primary Examiner*—Noah P. Kamen

*Attorney, Agent, or Firm*—Flynn, Thiel, Boutell & Tanis

[57] ABSTRACT

An engine has an exhaust manifold placed on an air outlet side thereof, and an auxiliary device and a water pump are both positioned on the air outlet side of the engine toward one axial end of a crankshaft. The auxiliary device and the water pump are situated respectively at under and upper portions of the engine. At least one exhaust port as located on one side of the engine at one axial end of the crankshaft is positioned offset relative to the other side of the engine toward the other axial end thereof, thereby forming an enlarged void space in the engine between the water pump and the exhaust manifold. A thermostat case portion for a thermostat is placed in the void space.

4 Claims, 7 Drawing Sheets

THERMOSTAT-MOUNTING POSITION STRUCTURE

FIELD OF THE INVENTION

This invention relates to an improved thermostat-mounting position structure which is designed to attain a compact size of an engine, and in which a thermostat case portion for a thermostat can be provided on an exhaust manifold side of the engine without needlessly protruding outwardly from the engine.

BACKGROUND OF THE INVENTION

Engines are classified by cylinder arrangement form as in-line, V-shaped, and the like. The in-line engine has cylinders arranged in series. The V-shaped engine has cylinders positioned in a V-shape. In the V-shaped engine, side cylinder heads are placed on respective upper portions of a substantially V-shaped cylinder block, whereby side cylinder banks are arranged in a substantially V-shape.

The V-shaped engine is defined with a void or space between the side cylinder banks. The space has an intake manifold placed therein. The V-shaped engine is further provided with cooling water distribution pipes such as cooling water intake and exhaust pipes. In addition, a thermostat is disposed midway between these two different cooling water pipes. The intake pipe introduces cooling water from a radiator into a water pump. The water pump is disposed on one side of the engine at one axial end of a crankshaft. The cooling water is collected on the other side of the engine at the other axial end of the crankshaft after passing through the cylinder banks. The aforesaid exhaust pipe returns the collected cooling water to the radiator.

An example of a mounting position structure for the thermostat is disclosed in published Japanese Patent Application Laid-Open No. 62-199921. A cooling system for an engine as disclosed in this publication includes a radiator inlet passage, a radiator outlet passage, a bypassing passage, and a thermostat. The radiator inlet passage interconnects a cooling water outlet of the engine and a radiator inlet. The radiator outlet passage interconnects a radiator outlet and a water pump inlet. The bypassing passage is connected between both of the above passages. The thermostat is disposed where the bypassing passage and the radiator outlet passage are joined together. In the thermostat-mounting position structure, a body of a water pump is provided on a front end surface of a cylinder block at a transverse position thereof. In addition, a thermostat case, in which the thermostat is positioned, is mounted behind the water pump body. This arrangement is designed to attain a reduction in and compactness of the entire engine length.

Another example is disclosed in published Japanese Patent Application Laid-Open No. 4-276137. In the thermostat structure for an engine as disclosed in this publication, an intake manifold has branch pipes arranged in a plane non-perpendicular but slanted at a predetermined angle with respect to the axis of the crankshaft of the engine. This arrangement causes a surplus gap to emerge from the void or space. Then, a thermostat is disposed in the surplus gap. As a result, the thermostat is placed without projecting from the engine, thereby making it possible to overcome an inconvenience that would otherwise increase the size of the engine. Further, the engine can be disposed in an engine room without interfering with other components, thereby providing improved loading capability to vehicles.

Still another example is disclosed in published Japanese Utility Model Application Examined No. 5-17383. In a cooling system for an engine disclosed in this publication, a cylinder block is defined with a thermostat case, and a cooling water hose is connected at one end to a cover of the thermostat case. The cooling water hose is connected at the other end to a radiator. Before terminating at the radiator, the cooling water hose extends through a space between first and second auxiliary devices. The auxiliary devices are arranged one atop the other, while being located near and in front of an exhaust manifold. Furthermore, the auxiliary devices partially extend between the cooling water hose and the exhaust manifold so as to reduce the quantity of passive heat from the exhaust manifold, thereby alleviating thermal load. As a result, the cooling water hose is isolated from radiant heat from the exhaust manifold without the use of particular heat-insulating materials.

As illustrated in FIG. 5, in conventional thermostat-mounting position structures, a large-sized auxiliary device 118 such as an A/C compressor is usually disposed on an air exhaust side of the engine 102 at a lower portion thereof. In addition, a water pump 120 and a thermostat case portion 124 are positioned on the same exhaust side.

In this construction, center positions of first through fourth exhaust ports 112-1, 112-2, 112-3, and 112-4 are coincident with center position (#1, #2, #3, #4) of unillustrated cylinders of the engine 102. This configuration causes a volumetric reduction in a void space 122 that is defined between the water pump 120 and an exhaust manifold 114. As illustrated in FIG. 6, the result is that the thermostat case portion 124 must be protruded outwardly from the engine 102 when being placed in the void space 122.

Consequently, such arrangement of the thermostat case portion 124 results in increased width L1 of the engine 102, which leads to a large-sized engine. This causes an inconvenience in that it is disadvantageous to place such a large engine into vehicles whose engine rooms are limited in space availability. In addition, the thermostat case portion 124 is spaced apart from the rotational center of the engine 102, i.e., from the crankshaft 116. This spacing causes another inconvenience in that the thermostat case portion 124 has less resistance to vibration, which is disadvantageous in view of practical use.

FIG. 7 illustrates another known engine 202 in which a large-sized auxiliary device 218 is placed on an air outlet side of the engine 202 at an upper portion thereof. In this case, either a water pump 220 or a thermostat case portion 224 must be positioned side by side with a crank case (not shown) under the auxiliary device 218.

However, when the water pump 220 is positioned side by side with the crank case, a water jacket for cooling the water pump 220 is eliminated. Accordingly, the engine 202 requires piping for interconnecting the water pump 220 and the water jacket that is defined in a cylinder block. However, such requirement involves laborious fabrication and a complicated construction as well, thereby causing inconveniences of: increased cost, which is disadvantageous from an economical viewpoint; and, a dimensional increase in the engine.

Furthermore, an auxiliary component such as an oil filter and a retention component such as an engine-mounting bracket must be provided behind a position at which either the water pump of the thermostat case portion is disposed. This arrangement creates an inconvenience, which is disadvantageous in view of practical use, in that it is difficult to provide a bypassing pipe to a thermostat in the thermostat case portion.

In order to obviate the above-described inconveniences, the present invention provides a thermostat-mounting position structure for an engine having an exhaust manifold placed on an air outlet side of the engine and having an auxiliary device and a water pump both positioned on the air outlet side of the engine toward one axial end of the crankshaft, the auxiliary device and the water pump being situated respectively at lower and upper portions of the engine, the improvement wherein at least one of exhaust ports located on one side of the engine at one axial end of the crankshaft is moved offset toward the other axial end thereof, thereby forming a void space between the water pump and the exhaust manifold, and wherein a thermostat case portion for a thermostat is placed in the void space.

According to the present invention having the above structure, at least one of the exhaust ports is positioned offset toward the other side of the engine at the other axial end of the crankshaft, whereby the void space is caused to be formed between the water pump and the exhaust manifold. Further, the void space has the thermostat case portion for a thermostat disposed therein. This structure eliminates the likelihood that the thermostat case portion needlessly extends outwardly from the engine. Accordingly, a smaller-sized engine is achievable, which consequently improves the loading capability of vehicles. Furthermore, the thermostat is located adjacent to the rotational center of the engine, and the resistance of the thermostat to vibration is enhanced.

DETAILED DESCRIPTION

Figure 1:
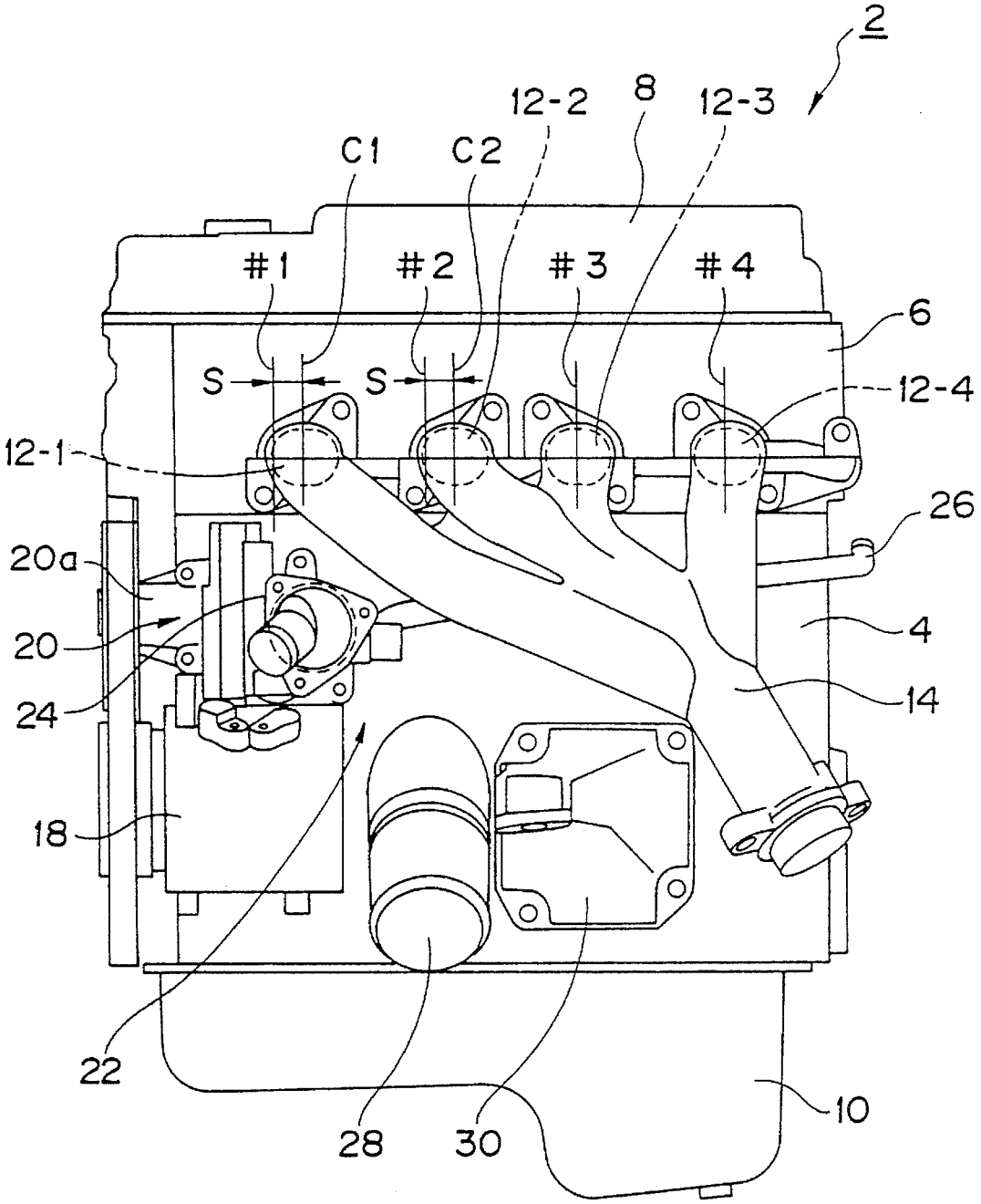
FIG. 1 is a right side view illustrating an engine according to an embodiment of the present invention.

An embodiment of the present invention will now be described in detail with reference to FIGS. 1 to 4, wherein reference numeral 2 denotes an engine, 4 a cylinder block, 6 a cylinder head, 8 a cylinder head cover, and 10 an oil pan.

The engine 2 is formed by: the cylinder block 4, the cylinder head 6 which is placed on an upper portion of the cylinder block 4, the cylinder head cover 8 which is positioned on an upper portion of the cylinder head 8, and the oil pan 10 which is attached to a lower portion of the cylinder block 4.

The cylinder head 6 is formed with a plurality of air intake and exhaust ports, e.g., four units of each respectively: first through fourth intake ports (not shown); and first through fourth exhaust ports 12-1, 12-2, 12-3, and 12-4. In addition, an intake manifold (not shown) is attached to the unillustrated first through fourth intake ports, thereby forming an air suction system. Further, an exhaust manifold 14 is attached to the first through fourth exhaust ports 12-1, 12-2, 12-3, and 12-4, thereby forming an air or exhaust discharge system.

The engine 2 is further provided with the following components on an air outlet side thereof: a large-sized auxiliary device 18 such as an A/C compressor, which is located at a lower portion of the engine 2 toward one end of the axis of a crankshaft 16 (the left side in FIG. 1); and a water pump 20 which is situated at an upper portion of the engine 2 toward one end of the axis of the crankshaft 16.

At least one of the exhaust ports 12, which is located on one side of the engine 2 at one axial end of the crankshaft 16, is moved offset toward the other side of the engine 2 at the other axial end thereof (the right side in FIG. 1). A void space 22 is thereby formed in the engine 2 so as to be exposed between the water pump 20 and the exhaust manifold 14. Further, a thermostat case portion 24 for a thermostat (not shown) is placed in the space 22.

In greater detail, respective center positions of the exhaust ports 12 correspond with center positions (#1, #2, #3, and #4) of unillustrated cylinders of the engine 2; and two of the center positions of the exhaust ports 12, for example, are positioned offset. More specifically, respective center positions Cl and C2 of the first and second exhaust ports 12-1 and 12-2 are moved offset from the side of one axial end of the crankshaft 16 toward the other axial end thereof by a predetermined distance S. This displaced arrangement develops the void space 22 in the engine 2 between the water pump 20 and the exhaust manifold 14. The space 22 is greater in volume than a conventional void space.

In addition, a water pump case portion 20*a*, which is used for the water pump 20, and the thermostat case portion 24 are formed integrally. The integrally structured case portions 20*a* and 24 are disposed in the space 22.

Reference numbers 26, 28, 30 and 32 respectively denotes a bypassing pipe, an oil filter, an engine-mounting bracket, and a thermocap pipe portion. The bypassing pipe 26 is provided in the engine 2 between the cylinder block 4 and the exhaust manifold 14 so as to communicate with the unillustrated thermostat in the thermostat case portion 24. The oil filter 28 is located on the air outlet side of the engine 2, and is positioned on the cylinder block 4 beneath the exhaust manifold 14. The engine-mounting bracket 30 is also located on the air outlet side of the engine 2, and is disposed on the cylinder block 4 beneath the exhaust manifold 14; however, the engine-mounting bracket 30 is situated closer than the oil filter 28 to the other axial end of the crankshaft 16.

Next, the operation of the present embodiment will be described.

The respective center positions C1 and C2 of the first and second exhaust ports 12-1 and 12-2 are positioned sidewardly offset from the centers of the respective cylinders away from one axial end of the crankshaft 16 toward the other axial end thereof by a predetermined distance S, thereby developing the void space 22 which is greater in volume than conventional void spaces. Then, the integrally formed water pump case portion 20*a* and thermostat case portion 24 are placed in the void space 22.

Figure 2:
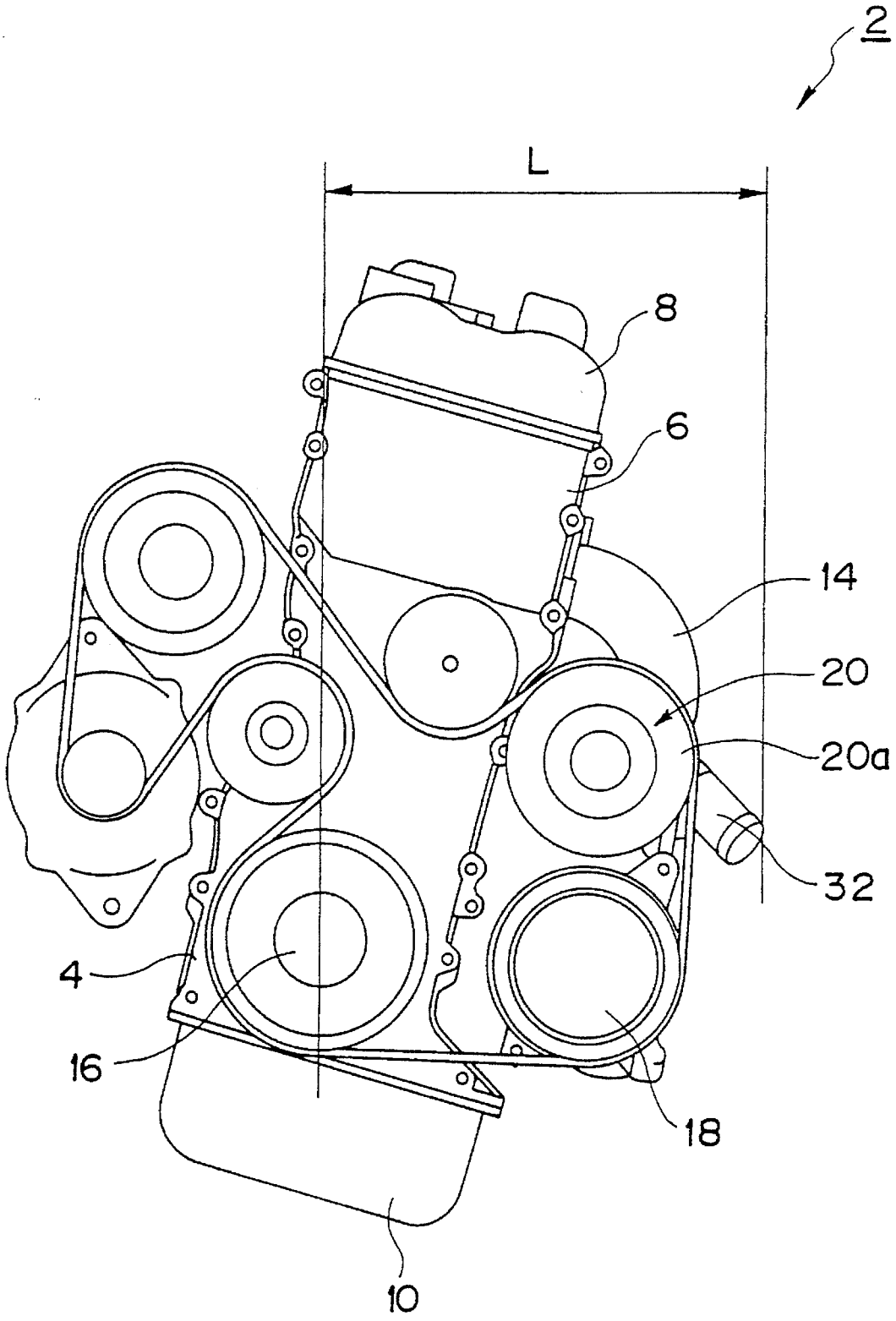
FIG. 2 is a front view showing the engine.

As shown in FIG. 2, the result is that width L of the engine 2 is made smaller than the conventional engine width.

Accordingly, in order to develop the space 22, it is only required that at least one of the exhaust ports 12, which is located on one side of the engine 2 at one axial end of the crankshaft 16, is offset relative to the other side of the engine 2 toward the other axial end thereof. This requirement can be met by a small design change.

In addition, in order to develop the space 22, it is only necessary that the respective center positions C1 and C2 of the first and second exhaust ports 12-1 and 12-2 are positioned offset on one side from one axial end of the crankshaft 16 toward the other axial end thereof by the predetermined distance S. This requirement can be met by a design change in the first and second exhaust ports 12-1 and 12-2. Consequently, this is advantageous in view of practical use.

Furthermore, since the thermostat case portion 24 is placed in the space 22 without the auxiliary device 18 being mounted at a different position, there is no likelihood that the thermostat case portion 24 protrudes outwardly from the engine 2. In addition, width L of the engine 2 can be made smaller than conventional engine width. This makes it possible to achieve a compact size of the engine 2 and thus improve the loading capability of vehicles.

Moreover, since the thermostat case portion 24 protrudes outwardly from the engine 2 in a reduced amount, a thermostat can be disposed adjacent to the rotational center of the engine. Consequently, the resistance of the thermostat to vibration can be increased.

Furthermore, the water pump case portion 20*a* and the thermostat case portion 24 are formed integrally, thereby providing a simplified structure which can easily be fabricated with fewer components at reduced cost. This is advantageous from an economical viewpoint.

Moreover, the water pump case portion 20*a* and the thermostat case portion 24 are formed integrally, thereby decreasing the chance of water leakage from the thermostat case portion 24. This is advantageous in view of practical use.

Figure 3:
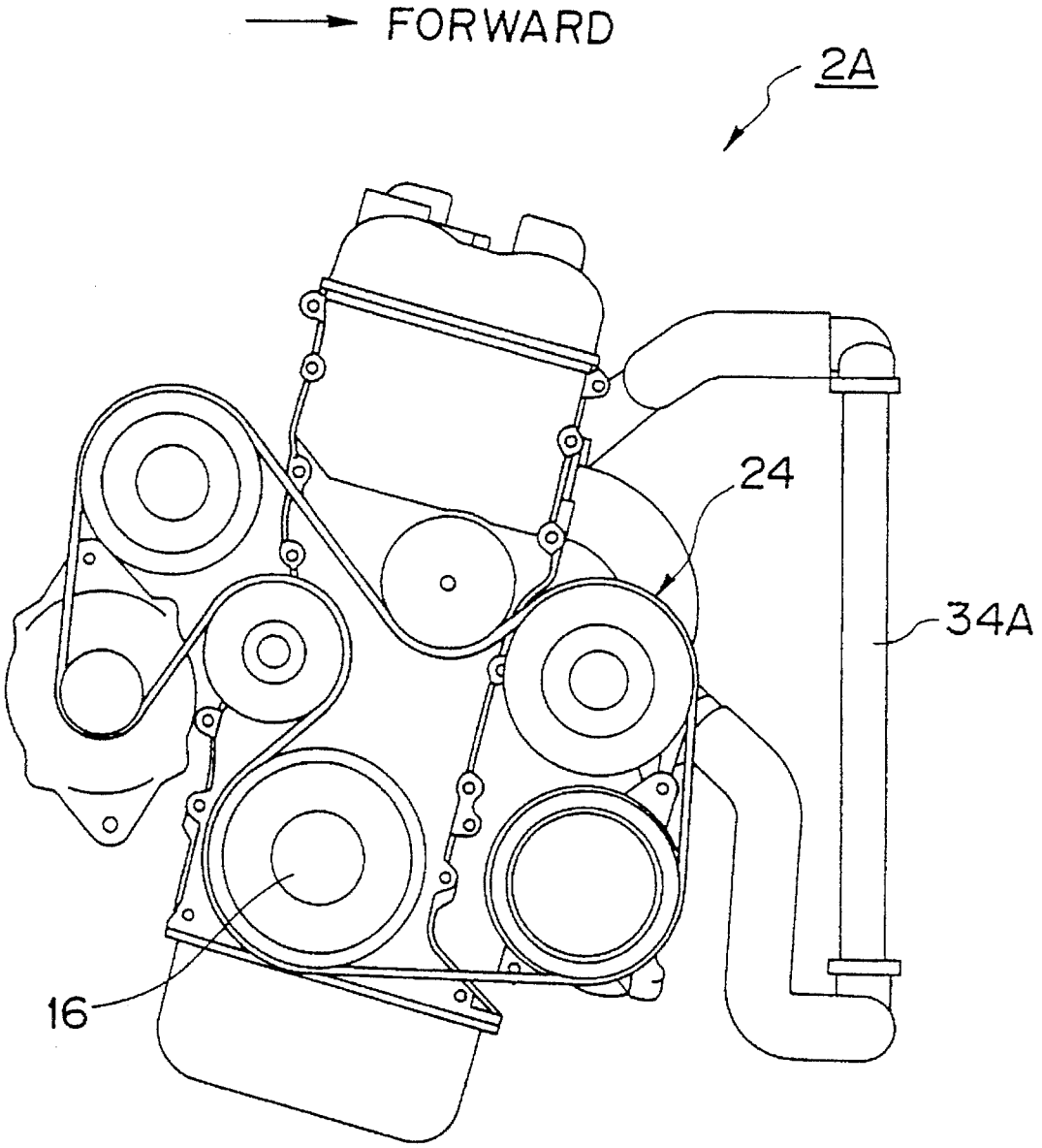
FIG. 3 is a left side view illustrating a horizontal engine in a state of being fitted with a thermostat case portion.
Figure 4:
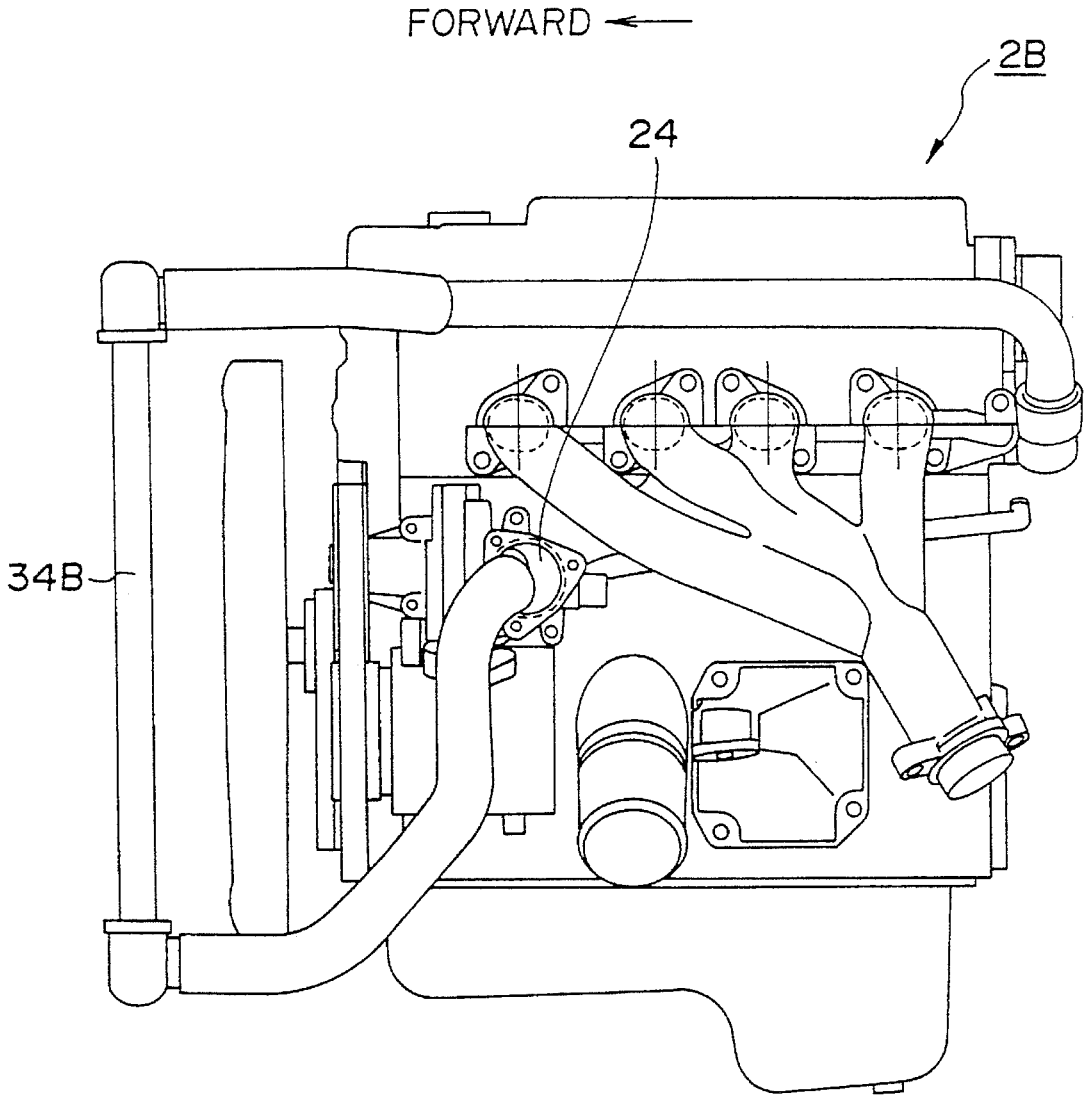
FIG. 4 is a right side view depicting a vertical engine in a state of being provided with a thermostat case portion.
Figure 5:
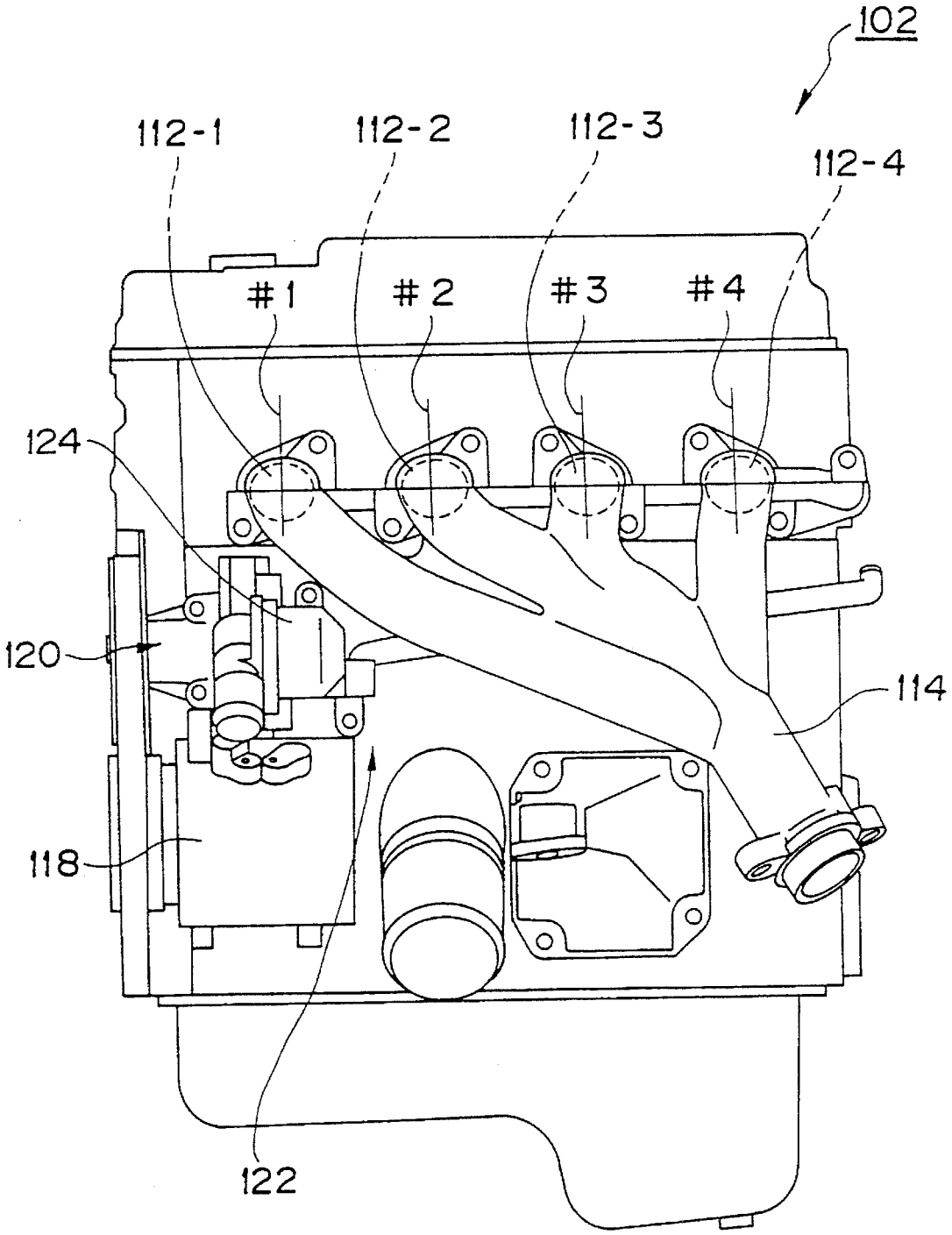
FIG. 5 PRIOR ART
FIG. 5 is a right side view illustrating an engine as one example of the prior art which underlies the present invention.
Figure 6:
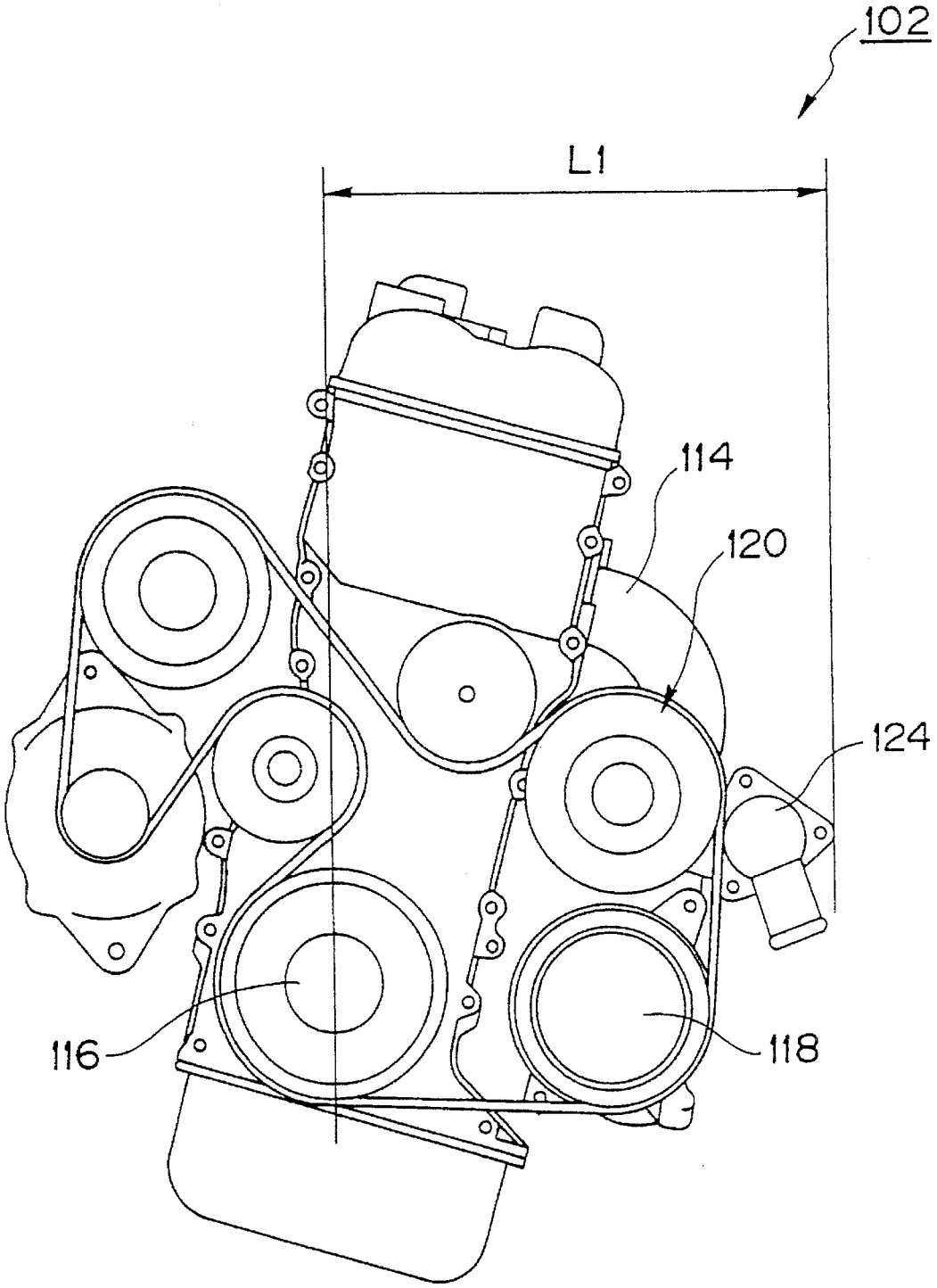
FIG. 6 PRIOR ART
FIG. 6 is a front view showing the engine of FIG. 5.
Figure 7:
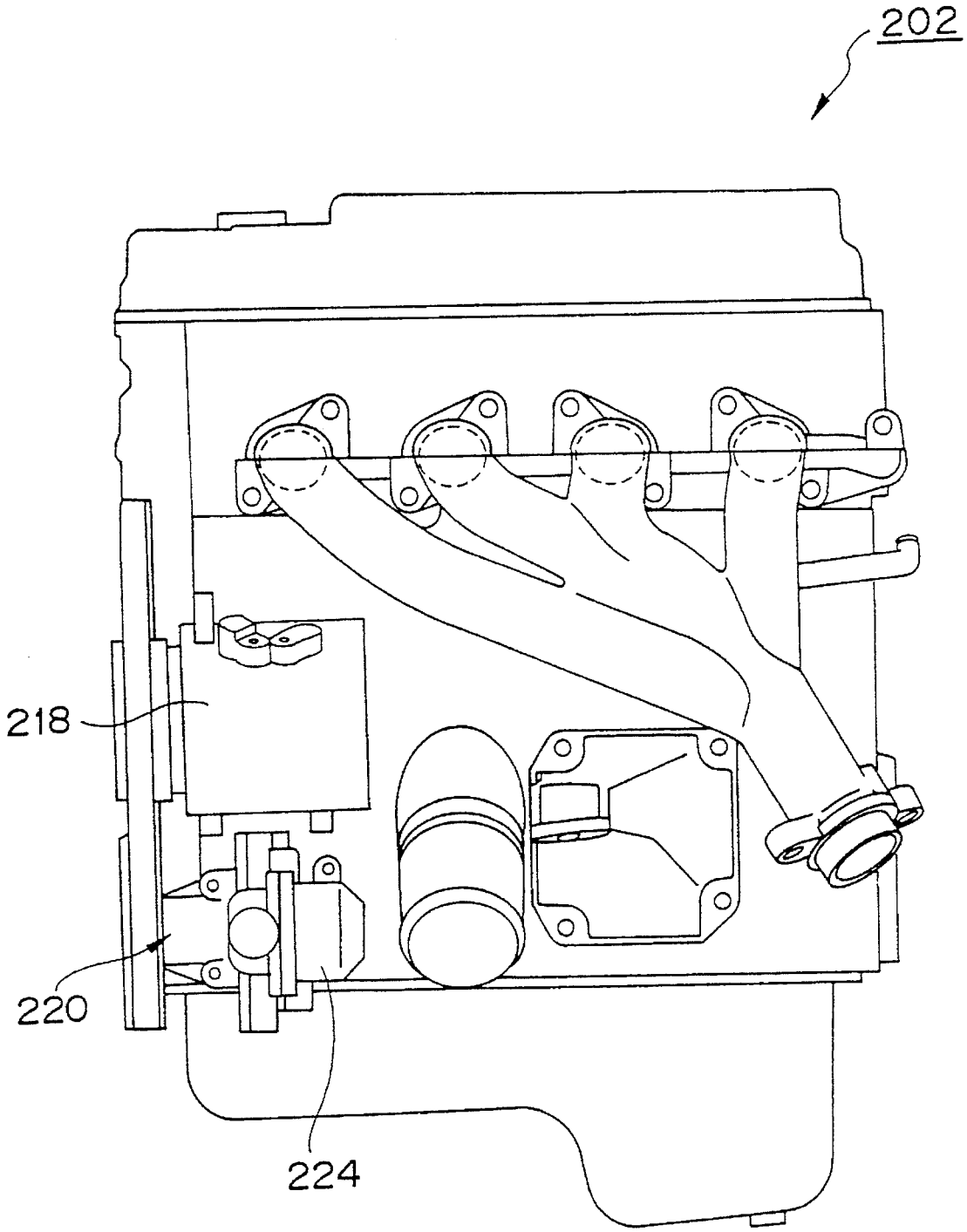
FIG. 7 PRIOR ART
FIG. 7 is a right side view showing an engine as another example of the prior art which underlies the present invention.

In addition, since the thermostat case portion 24 is positioned on one side of the engine 2 at one end of the axis of the crankshaft 16, it follows that the thermostat case portion 24 is located toward a radiator 34A in a front engine front drive (FF) vehicle, or adjacent to a radiator 34B in a front engine rear drive (FR) vehicle. As a result, as shown in FIG. 3 and FIG. 4, a common layout can be utilized in a horizontal engine 2A and a vertical engine 2B without the possibility of an increase in number of components. This is advantageous in view of practical use.

It will be understood that the present invention is not limited to the above-described embodiment, but is intended to cover various applications and modifications or changes.

For example, according to the present embodiment, among the respective center positions of the exhaust ports which correspond with the center positions (#1, #2, #3, and #4) of the cylinders of the engine, two of them are moved offset in order to allow the void space to be formed emerge. That is, the respective center positions of the first and second exhaust ports are moved offset along the side from one axial end of the crankshaft toward the other axial end thereof by the predetermined distance S. However, the center position of the first exhaust port alone, or alternatively the center positions of three or more of the exhaust ports, may be offset in the same manner as above. By way of a further alternative, when several exhaust ports are moved offset, each of them may be offset by a different amount.

Moreover, according to the present embodiment, the water pump case portion and the thermostat case portion are formed integrally. Alternatively, these case portions may be formed individually for separate arrangement.

As amplified in the above description, a thermostat-mounting position structure according to the present invention is employed in an engine which has an exhaust manifold placed on an air outlet side of the engine. The engine further has an auxiliary device and a water pump both positioned on the air outlet side of the engine toward one axial end of a crankshaft; however, the auxiliary device and the water pump are located respectively at lower and upper portions of the engine. In the thermostat-mounting position structure, at least one of exhaust ports, which is located on one side of the engine at one axial end of the crankshaft, is offset toward the other axial end of the engine. A void space is thereby formed between the water pump and the exhaust manifold. Then, a thermostat case portion for a thermostat is placed in the void space. Accordingly, in order to create the void space, it is only required that at least one of the exhaust ports, which is located on one side of the engine at one axial end of the crankshaft, is positioned offset toward the other axial end thereof. This requirement can be met by a small design change, and this is advantageous in view of practical use. Furthermore, since the thermostat case portion is positioned in the void space, there is no likelihood that the thermostat case portion protrudes outwardly from the engine. In addition, width of the engine can be made smaller than conventional engine width. This makes it possible to provide a smaller-sized engine and thus improve the loading capability of vehicles. Moreover, since the thermostat case portion protrudes outwardly from the engine in a reduced amount, a thermostat can be disposed adjacent to the rotational center of the engine. As a result, the resistance of the thermostat to vibration can be increased. Moreover, since the thermostat case portion is positioned on one side of the engine at one axial end of the crankshaft, it follows that the thermostat case portion is located toward a radiator in a front engine rear drive (FF) vehicle, or adjacent to a radiator in a front engine rear drive (FR) vehicle. As a result, a common layout can be utilized in a horizontal engine and a vertical engine without the possibility of an increase in number of components. This is advantageous in view of practical use.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In a thermostat-mounting position structure for an engine having an exhaust manifold placed on an air outlet side of said engine and having an auxiliary device and a water pump both positioned on said air outlet side of said engine toward one axial end of a crankshaft, said auxiliary device and said water pump being situated respectively at under and upper portions of said engine, the improvement wherein at least one exhaust port of a cylinder as located on one side of said engine at one axial end of said crankshaft is positioned sidewardly offset from a centerline of the cylinder toward the other axial end of the engine to form an enlarged void space in said engine between said water pump and said exhaust manifold, and wherein a thermostat case portion for a thermostat is placed in said void space.

2. In a vehicle internal combustion engine having an exhaust manifold placed on an air outlet side of said engine and having an auxiliary device and a water pump both positioned on said air outlet side of said engine toward one axial end of a crankshaft of the engine, said auxiliary device and said water pump being situated respectively at lower and upper portions of said engine, said engine having a plurality of substantially parallel cylinders disposed within a row and each having an exhaust port communicating therewith and disposed on the air outlet side of said engine, the exhaust ports as respectively associated with some of said cylinders being disposed in intersecting relationship with centerlines of the respective cylinders, comprising the improvement wherein at least one said exhaust port as located on said air outlet side of said engine at one axial end of said crankshaft is positioned sidewardly offset from the centerline of the respective cylinder away from said one axial end of the crankshaft toward the other axial end thereof by a predetermined distance to form an enlarged void space adjacent said side of said engine between said water pump and said exhaust manifold, and a thermostat case containing therein a thermostat positioned in said void space and fixedly mounted relative to said engine.

3. An engine according to claim 2, wherein said thermostat case is fixedly mounted to said water pump.

4. An engine according to claim 3, wherein a case of the water pump and the thermostat case are integrally formed as a common case.

* * * * *